United States Patent [19]

Strong

[11] Patent Number: 4,962,872

[45] Date of Patent: Oct. 16, 1990

[54] CONTAINER CLOSURE DEVICE

[75] Inventor: Bernard Strong, Tarzana, Calif.

[73] Assignee: Pro Pak California, City of Industry, Calif.

[21] Appl. No.: 267,043

[22] Filed: Nov. 3, 1988

[51] Int. Cl.[5] ..... B67D 3/00

[52] U.S. Cl. ..... 222/516; 222/513; 222/559; 222/553; 222/542

[58] Field of Search ..... 222/517, 516, 513, 559, 222/553, 548, 511, 481, 542

[56] References Cited

U.S. PATENT DOCUMENTS

| | | | |
|---|---|---|---|
| 1,404,883 | 1/1922 | Murray | 222/516 |
| 2,636,649 | 4/1953 | Corriveau | 222/516 |
| 3,400,866 | 9/1968 | Fattori | 222/511 |
| 3,410,462 | 11/1968 | Donovan | 222/516 |
| 3,430,824 | 3/1969 | Conners et al. | 222/568 X |
| 3,493,146 | 2/1970 | Conners et al. | 222/540 X |
| 3,563,368 | 2/1971 | McHugh | 222/517 X |
| 4,190,173 | 2/1980 | Mason et al. | 222/516 X |

FOREIGN PATENT DOCUMENTS 857777 12/1952 Fed. Rep. of Germany ..... 222/516

*Primary Examiner*—Joseph J. Rolla
*Assistant Examiner*—David H. Bollinger
*Attorney, Agent, or Firm*—Lyon and Lyon

[57] ABSTRACT

A closure dispensing device or valve and method which may be applied to a liquid container. The preferred closure device includes a channel body with an extending channel portion. The channel portion has an internal channel with an exit port. The exit port may include a circular seat into which an O-ring may be placed. A spring seal mechanism is placed in tension over the channel portion, the spring seal mechanism having a flat surface for engaging and sealing against the O-ring. To actuate the dispenser, the user moves the leg of the pivoted "U" spring away from the O-ring and allows liquid to pass therebetween. When the user releases the leg, the spring tension provided by the pivoted "U" spring restores the seal between the flat surface of the leg and the O-ring.

17 Claims, 1 Drawing Sheet

CONTAINER CLOSURE DEVICE

BACKGROUND OF THE INVENTION

The field of the present invention is liquid dispensing assemblies, valves or taps and more particularly is directed to a dispensing assembly for use in drawing off liquid from the bottom of a container.

A typical container is a plastics molded bottle such as disclosed in U.S. Pat. No. 3,430,824. The container is typically made by a blow molded polyethylene process and comes in various shapes and sizes. Another well known container is known as a "bag within a box" where liquid is held in collapsible liner bag within a box. Typically these and other containers have an outlet neck located at the bottom of the container so that liquid may proceed by gravity flow into a receiving receptacle. Since the dispensing assembly is located at the bottom of the container, the assembly is constantly subjected to liquid pressure. The dispensing assembly must be leak proof and readily operable to dispense a desired quantity of liquid.

Heretofore there have been two primary dispensing valves. One such valve is the push-pull valve such as disclosed in U.S. Pat. No. 3,493,146. The push-pull valve includes a valve sleeve slidably mounted in a positioning sleeve, the valve sleeve having a opening therein which becomes exposed when the valve sleeve is pulled outward past the edge of the positioning sleeve thereby allowing fluid to flow out through the aperture.

Another dispensing valve is the diaphragm toggle-type such as disclosed in U.S. Pat. No. 3,400,866. The diaphragm toggle-type valve has a diaphragm wall which extends concavely into a spout opening contacting the inner edge of the spout thereby forming a closure or pressure seal therebetween. The valve is operated by manually actuating a toggle piece, distorting the wall, which allows fluid to pass between the diaphragm wall and the spout. Upon release of the toggle, the diaphragm returns to its original shape re-establishing the pressure seal.

Both the push-pull and the diaphragm toggle-type valves impart some sort of sliding, slipping, or lifting motion on the container in order to actuate the valve mechanism. The actuation motion required to operate the valve is often difficult. In addition, these devices require either a distortion or a sliding contact of the sealing surface which can reduce the seal effectiveness over use.

SUMMARY OF THE INVENTION

The present invention relates to a new closure dispensing device which may be applied to a liquid container. The closure device includes a channel extending to a port and a substantially rigid closure member biased against the port. A means is provided to withdraw the closure member from the port to open the device.

Therefore an object of the present invention is to provide an improved dispensing device or valve for liquid containers. Other and further advantages will appear hereinafter.

DESCRIPTION OF THE PREFERRED EMBODIMENT

Figures 1, 2, 3, 4, 5:
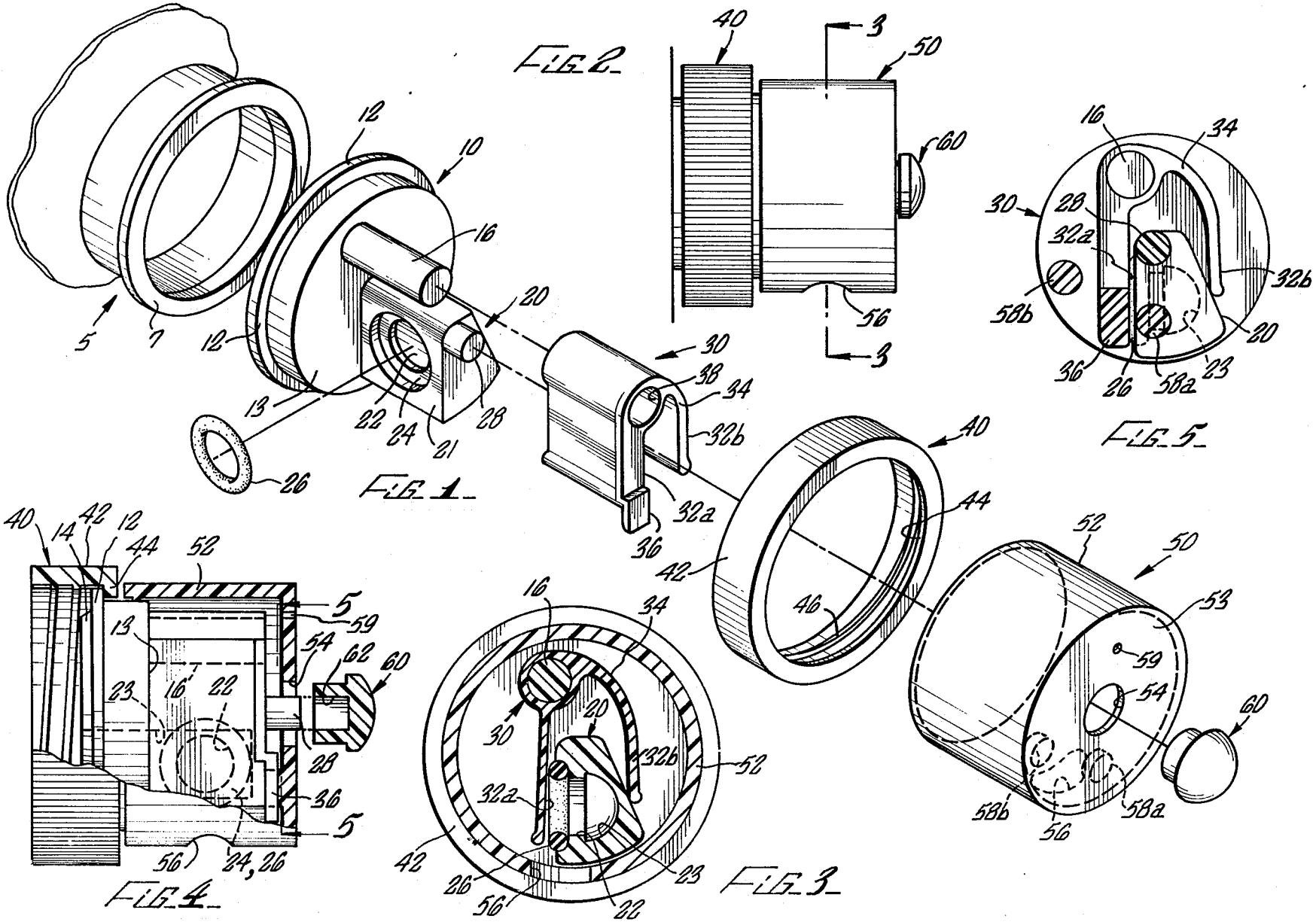
FIG. 1 is an exploded perspective view of a dispensing device according to the present invention.
FIG. 2 is an assembled side elevation view of the dispensing device.
FIG. 3 is a cross-sectional view of the closure device of FIG. 2 taken along the line 3—3.
FIG. 4 is a side elevation view in partial cross-section of the closure device of FIG. 2.
FIG. 5 is a cross-sectional view of internal valve mechanisms of the closure device of FIG. 4 taken along the line 5—5.

A preferred embodiment will now be described with reference to FIGS. 1 through 5. For ease of description, any numeral representing an element in one figure will represent the same element in any other figure.

The closure device includes a body 10 having a disk-like face 13 and a retaining flange 12 on one end thereof. The retaining flange 12 includes a tapered seal 14 which is sized to fit within the container neck 7 of a container of bottle 5. A cap or collar 40 having a rim or shoulder 44 corresponding to the retaining flange 12 is employed to secure the body 10 to the container neck 7. The cap 40 has internal threads 46 which threadably engage the bottle neck 7. Though the neck 7 shown in FIG. 1 has a single rim, the neck 7 may be threaded to better mate with the threads 46 on the cap 40. As the threaded cap 40 is screwed on to the container neck 7, the tapered seal 14 (as best viewed in FIG. 4) on the rear face of the retaining flange 12 is wedged between the rim 44 and the neck 7 creating a sealing contact along the internal portion of the container neck 7 thus making a leak-proof seal in that area. Alternately, the cap 40 and the neck 7 may be engaged to connect with a snap fit in place of the illustrated threaded connection. Alternately the cover 50 may be provided with a snap fit connection.

The body 10 includes a channel portion 20 and a pivot shown as an integral pivot rod 16, both extending axially forward from the disk face 13. A spring seal mechanism 30 may be placed over the channel portion 20 and integral pivot 16. A cylindrical cover piece 50 covers the assembled unit, as viewed in FIG. 2, and as secured by a button 60.

The channel portion 20 within the main body 10 appears to have a wedge or pie shaped cross section and has a channel 23 which extends axially through the face 13 to provide fluid communication with the fluid in the container 5. A port or channel 22 extends from the channel 23 out through the face 21 of the channel portion 20. The face 21 includes a ring seat 24 in which an O-ring or gasket 26 is seated. The channel portion 20 has a center shaft 28 extending axially forward therefrom for engagement with the cap 60. As best viewed in FIG. 4, the cap 60 has a bore 62 into which the center shaft 28 may be inserted to secure the cover 50.

The spring seal mechanism 30 has an opening 38 into which the integral pivot 16 may be inserted. The spring seal mechanism 30 appears as an inverted "U" shape which straddle the channel portion 20. One of the legs of the "U" spring has a flat face **32*a* which seals against the O-ring 26. The legs of the "U" spring 30 are forced apart to fit over the channel portion 20 thereby providing a sealing force of the surface 32*a* against the O-ring 26. The amount of sealing pressure can be selected by simply extending or reducing the arc 34 on the leg 32*b***.

The cover 50 is mounted on and turns freely about the center shaft 28 which is an integral part of the main body 10. The cover 50 is retained by a button 60 which snaps onto the center shaft 28. The button 60 has a bore 62 with an internal diameter to effect a drive fit to the center shaft 28. The cover 50 includes a hole 56 which is located on the bottom of the cover side 52. The cover 50 is open on one end (into which the valve body 10 is inserted) and has a closed end face 53 on its forward end. The end face 53 has an axially centered hole 54 within which the button 60 seats.

The cover 50 also includes a lifting pin 58*a* and a stopping pin 58*b* which are knobs or protrusions extending axially inward from the end face 53 of the cover 50. The knobs 58*a* and 58*b* correspond to and contact a raised trigger 36 on the leg 32*a* of the "U" spring seat mechanism 30.

FIG. 5 illustrates the closure mechanism in the closed position and FIG. 3 illustrates the closure mechanism in the open position. In FIG. 5, the leg 32*a* is pressed against the O-ring 26 closing off the flow of liquid from the channel 23. As the cover 50 is rotated clockwise about the center shaft 28 (as viewed in FIG. 5), the lifting pin 58*a* is moved into contact with the raised trigger or lifting flap 36 on the leg 32*a* thereby lifting the sealing face 32*a* of the "U" spring 30 away from the O-ring 26 and, as shown in FIG. 3, providing a path for liquid to flow out of the channel 2 through the port 22 and then down through the aperture 56 within the cover 50. As the cover 50 is released, the leg 32*a* springs back to the closed position against the O-ring 26 rotating the cover 50 counterclockwise in the process. The cover 50 is prevented from overrotating in the counterclockwise direction by contact of the stopping pin 58*b* against the lifting flap 36. The rotary actuation action avoids imparting forces on the container neck 7 which could cause undesireable movement of the container.

A gasket or rotary sealing ring (not shown) may be provided between the back end of the cover 50 and either the body 10 or the collar 40 to prevent any undue leakage out from the cover 50. A vent hole 59 is provided in the cover 50 to avoid forming a vacuum in the upper half of the cover 50 which could otherwise trap some residual liquid within the cover 50 and cause potential dripping after closure.

The closure device is typically constructed from injection moldings. The O-ring 26 is preferably made from resilient material such as rubber which would normally be compression molded.

As described above, the sealing surface 32*a* is preferably a flat surface which evenly presses into contact against the O-ring 26. This is accomplished by aligning the surface 32*a* with the center of pivot 16 as best viewed in FIG. 5. When the trigger 36 is released after actuation, the leg with the sealing surface 32*a* pivots precisely to its starting position in contact with the O-ring 26 without sliding against it. Wear on the O-ring 26 and the sealing surface 32*a* are reduced and integrity of the seal is maintained by this precisely aligned angle of approach.

The pivot 16 insures proper alignment of the sealing surface 32*a*, but shapes other than "U" spring of plastics material may be implemented. For example, the "U" spring may have a more wishbone shape with the other leg 32*b* secured in a groove in the side of channel portion 20. Such a configuration could eliminate the pivot 16.

Other types of springs such as a metal or plastics spring of more conventional design may be employed, at possible greater cost. An elastic band could be wrapped around the channel portion 20 to provide the return force at possible greater assembly cost.

The O-ring 26 provides an effective seal because the rounded surface of O-rings yields an almost line contact against a sealing surface. Such a line contact results in high local pressures producing superior sealing characteristics thereby reducing the required overall spring force needed to be applied to achieve an effective seal. Alternately, a gasket could be used in place of the O-ring 26, but higher forces might be required.

The O-ring 26 is preferably a standard rubber O-ring having a 70 durometer hardness. A softer O-ring could be used and would provide for some misalignment, but would have inferior recovery properties and possibly a shorter life.

Another alternate sealing combination could include molding the sealing surface 32*a* and/or the corresponding surface around port 22 (or entire components) out of a softer, flexible material such as rubber or a thermoplastic elastomer. The costs of making components out of such flexible material would likely be greater.

The force applied by the spring mechanism 30 is dependent upon factors including: length, thickness/width, angle of the "U", and the angle of the slope/arc 34. Upon actuation, most of the flexure in the spring 30 occurs in the arc 34 and around the pivot 16. By placing the arc 34 in the other leg 32*b*, flexing is localized there and flexure of the sealing surface 32*a* is minimized enhancing its precise pivoting return to contact with the O-ring 26 upon release.

The design of the dispensing mechanism is also affected by size constraints as the threaded collar 40 preferably fits over all the internal components during assembly. By having the passage of liquid bent 90° from channel 23 to channel 22, space for the spring mechanism 30 is maximized. The wedge shape of the channel portion 20 also enhances internal space. As described above, spring force is dependent on length. The channel portion is offset maximizing room for the "U" spring 30 allowing greater length with greater corresponding force. The U-shape itself increases force because the force is dependent on the total length of both legs.

A knurled or grooved pattern may be applied to the outer surfaces or the cover wall 52 and the threaded collar wall 42 to provide a better gripping surface for the user.

Practically, the closure device may be operated or modified to operate without the cover 50. With the trigger 36 exposed, the user may simply manually actuate the trigger 36 and allow liquid to flow directly down into a persons's cup for example. The trigger 36 may be suitably modified or combined with, as an example, a level or push button to provide for convenient actuation.

The closure device may also be modified so as to provide evidence of tampering. One such method can be effected by providing a tapered notch inside of the cover 50 which will ride up only in one direction over a matching projection of the body 10 thus permitting the cover 50 to ride pass and over the projection only once in a clockwise direction and provide a suitable indication that tampering was thereby evident. Yet another tamper evident design, a sealing tab may be provided on the periphery of the cover 50 so as to form a heat seal engagement with the body 10 and thus provide a tamper evident assembly.

Thus a new closure device or valve mechanism has been shown and described. Though certain advantages and alternatives have been described, many more applications and modifications will become apparent to those skilled in the art from the descriptions herein. The invention therefore is limited only in the spirit of the claims that follow.

What is claimed is:

1. A valve comprising
(1) a body including
(a) a disk portion, and
(b) a channel portion extending axially out from said disk portion and having (i) a port in a first side of the channel portion, (ii) a channel extending through the disk portion providing a fluid path through the disk to the port, and (iii) a sealing seat in the port;
(2) a connecting means adapted for sealably attaching the body to a fluid outlet; and
(3) a spring seal mechanism generally having a "U" shape with the channel portion wedged therein, the spring seal mechanism having a first leg with a substantially flat surface engaging the sealing seat in the port,
wherein the spring seal mechanism biases the flat surface of the fist leg into engagement with the sealing seat of the port.

2. The valve according to claim 1 further comprising an O-ring disposed in the sealing seat.

3. The valve according to claim 1 further comprising a pivot rod extending axially out from the disk portion to one side of the channel portion, wherein the spring seal mechanism is mounted on the pivot rod.

4. The valve according to claim 1 wherein the port is disposed in a plane perpendicular to the disk portion.

5. The valve according to claim 1 wherein the first leg of the spring seal mechanism is disposed in a plane perpendicular to the plane of the port.

6. The valve according to claim 1 further comprising a cylindrically shaped cover having an open end and a closed end, the cover enclosing the channel portion with its open end abutting against the disk portion, the cover having a hole through a side thereof.

7. The valve according to claim 6 wherein the cover is rotatably mounted onto the valve body, the cover including contact means for engaging the first leg of the spring seal mechanism, wherein the cover is adapted such that rotation of the cover disengages the flat surface from the sealing seat.

8. The valve according to claim 1 wherein the spring seal has a second leg on a side of the channel portion opposite the port, the legs of the spring seal mechanism being flexed apart in order to straddle the channel portion.

9. The valve according to claim 1 further comprising a gasket between the sealing seat and the flat surface.

10. A valve for dispensing fluid from a container, comprising
(1) a valve body including
(a) a disk portion securable to the container and having a passage therethrough,
(b) a channel portion attached to the disk portion and having (i) a port on an outward end thereof and (ii) a channel connecting the port and the passage off the disk portion,
(c) a sealing surface about the port, and
(d) a spring seal mechanism for sealing off the port, the spring seal mechanism including a sealing face and a spring means for biasing the sealing face against the sealing surface of the port; and
(2) means for selectively disengaging the sealing face from against the port allowing fluid to be dispensed out through the port,
wherein the spring seal mechanism is constructed and arranged such that the sealing face is engaged and disengaged in a non-sliding movement perpendicularly away from the sealing surface of the port.

11. The valve according to claim 10 wherein the port comprises a ring seat with an O-ring positioned therein, the O-ring providing a tight seal between the sealing face and the ring seat.

12. The valve according to claim 10 further comprising
(2) a trigger means operable for selectively disengaging the the sealing face from against the port.

13. The valve according to claim 10 further comprising a cylindrically shaped cover having an open end and a closed end, the cover enclosing the channel portion with its open end abutting against the disk portion, the cover having a hole through a side thereof.

14. The valve according to claim 13 further comprising
(2) a trigger means operable for selectively disengaging the sealing face from against the port.

15. The valve according to claim 10 wherein the port is disposed in a plane perpendicular to the disk portion.

16. A valve for dispensing fluid from a container, comprising
(1) a valve body including
(a) a disk portion securable to the container and having a passage therethrough,
(b) a channel portion attached to the disk portion and having (i) a port on an outward end thereof and (ii) a channel connecting the port and the passage of the disk portion,
(c) a sealing surface about the port, and
(d) a spring seal mechanism for sealing off the port, the spring seal mechanism including a sealing face and a spring means for biasing the sealing face against the sealing surface of the port;
(2) a trigger means operable for selectively disengaging the sealing face from against the port allowing fluid to be dispensed out through the port; and
(3) a cylindrically shaped cover having an open end and a closed end, the cover enclosing the channel portion with its open end abutting against the disk portion, the cover having a hole through a side thereof,
wherein the cover is rotatably mounted onto the valve body, the cover including contact means for engaging the trigger means of the spring seal mechanism, wherein rotation of the cover by a given degree actuates the trigger means.

17. A valve for dispensing fluid from a container, comprising
(1) a valve body including
(a) a disk portion securable to the container and having a passage therethrough,
(b) a channel portion attached to the disk portion and having (i) a port on an outward end thereof and (ii) a channel connecting the port and the passage of the disk portion,
(c) a sealing surface about the port, and
(d) a spring seal mechanism for sealing off the port, the spring seal mechanism including a sealing face and a spring means for biasing the sealing face against the sealing surface of the port; and
(2) means for selectively disengaging the sealing face from against the port allowing fluid to be dispensed out through the port,
wherein the spring means comprises a "U" shaped spring having a first leg, which includes the sealing face, positioned against the port and a second leg on a side of the channel portion opposite the port, the legs of the "U" shaped spring being flexed apart in order to straddle the channel portion.

* * * * *